United States Patent [19]

Shinomoto

[11] Patent Number: 4,581,911

[45] Date of Patent: Apr. 15, 1986

[54] CANTILEVER TYPE ROLLING MILL

[75] Inventor: Yoshiyuki Shinomoto, Himeji, Japan

[73] Assignee: Kabushiki Kaisha Kobe Seiko Sho, Kobe, Japan

[21] Appl. No.: 586,448

[22] Filed: Mar. 5, 1984

[30] Foreign Application Priority Data

| | | | |
|---|---|---|---|
| Mar. 7, 1983 | [JP] | Japan | 58-32669[U] |
| May 11, 1983 | [JP] | Japan | 58-83372 |
| May 12, 1983 | [JP] | Japan | 58-71514[U] |
| May 17, 1983 | [JP] | Japan | 58-74796[U] |

[51] Int. Cl.[4] ..... B21B 31/34

[52] U.S. Cl. ..... 72/35; 72/237; 72/247; 72/248

[58] Field of Search ..... 29/125, 129, 130; 72/237, 238, 248, 249, 247, 35, 36

[56] References Cited

U.S. PATENT DOCUMENTS

| | | | |
|---|---|---|---|
| 3,793,869 | 2/1974 | Hutnagl et al. . | |
| 4,114,416 | 9/1978 | Bier et al. . | |
| 4,468,944 | 9/1984 | Foss | 72/35 |

FOREIGN PATENT DOCUMENTS

| | | |
|---|---|---|
| 148732 | 6/1981 | Fed. Rep. of Germany . |
| 48-17701 | 5/1973 | Japan . |
| 1252549 | 11/1971 | United Kingdom . |

*Primary Examiner*—Lowell A. Larson
*Assistant Examiner*—Robert Showalter
*Attorney, Agent, or Firm*—Oblon, Fisher, Spivak, McClelland & Maier

[57] ABSTRACT

A cantilever type rolling mill having a pair of roll shafts rotatably supported in a roll housing on a roll stand, the rolling mill including a tension member provided axially through the center of a roll shaft and having the outer end thereof projecting out of the roll shaft; a roll unit holding a ring roll between a tapered sleeve engaging with one end face and inner periphery of the ring roll and a pressing washer engaging with the other end face of the ring roll; a roll compressing tool detachably engageable with the projecting end of the tension member and incorporating a hydraulic piston-cylinder, the roll compressing tool having a nut member threadedly fitted on the circumference thereof; a plurality of crown splines formed on the outer peripheries of the nut member and pressing washer; and an extraction ring having a crown spline on the inner periphery thereof and slidably and fixably engageable with the crown splines of the nut member and pressing washer.

4 Claims, 23 Drawing Figures

CANTILEVER TYPE ROLLING MILL

BACKGROUND OF THE INVENTION

1. Field of the Invention

This invention relates to improvements in a cantilever type rolling mill employing a roll assembly adapted to transmit torque to a ring roll by frictional force produced by application of a compressive force on the opposite lateral sides of the ring roll.

2. Description of the Prior Art

For mounting a ring roll on a roll shaft of a cantilever type rolling mill for wire rods or steel rods, it has been the conventional practice to provide a tapered surface on the circumference of a roll shaft and to insert an internally tapered sleeve between the roll shaft and an axial cylindrical hole of a ring roll for the purpose of mounting the ring roll fixedly on the roll shaft and transmitting torque to the ring roll by the frictional force of its cylindrical inner peripheral surface.

With such a construction, a large tensile stress occurs at outer peripheral portions of the ring roll due to insertion of the tapered sleeve, so that a crack is very likely to take place in a direction perpendicular to the circle of the ring upon an increase of in the torque to be transmitted In a case where the ring roll consists of an ultra hard roll which is smaller in thermal expansion (about ½) as compared with the roll shaft and sleeve of steel, a greater thermal expansion takes place on the part of the roll shaft upon a temperature elevation, inviting cracking of the ring roll by application thereto of an excessive tensile stress. In addition, as torque transmission to the ring roll is effected solely by the frictional force of its inner surface, sooner or later most of costly ultra hard rolls have to be scrapped due to a limit in critical stress, resulting in a material increase in cost. Moreover, precision is required with regard to the pressing force of a tapered sleeve to be inserted for torque transmission by internal pressure in consideration of the above-mentioned problem of tensile stress of the ring roll.

SUMMARY OF THE INVENTION

It is a primary object of the present invention to eliminate the above-mentioned conventional drawback or cracking problem in the rolls of a cantilever type rolling mill.

It is a more particular object of the present invention to provide a roll assembly for cantilever type rolling mill, which is constructed to transmit torque to a ring roll mainly by frictional force produced by application of compressive force on lateral sides of the ring roll.

It is another object of the present invention to provide a cantilever type rolling mill optionally employing, in combination with the above-mentioned roll assembly, a coupling head support mechanism which is adapted to support a coupling head in horizontal state automatically upon extraction of a roll shaft to permit facilitated roll replacement without requiring laborious efforts; a pass clearance adjusting mechanism which facilitates assembly and disassembly of eccentric cartridges in a roll housing; a pass clearance indicator which is adapted to indicate the pass clearance gage by means of a rotary dial rotatable in proportion to the rotation of eccentric cartridges; and/or a caliber adjusting mechanism which is adapted to press eccentric cartridges in a radial direction to clamp the same securely to a roll stand during rolling operation while permitting rotation of eccentric cartridges for the adjustment of the pass clearance and axial displacement for the adjustment of roll caliber in the axial direction.

According to a fundamental aspect of the present invention, there is provided a cantilever type rolling mill having a pair of roll shafts rotatably supported in a roll housing on a roll stand, characterized in that the mill is provided with a roll assembly comprising; a tension member inserted axially through the center of the roll shaft and having its outer end projected out of the roll shaft; a roll unit holding a ring roll between a tapered sleeve engaging with one end face and the inner periphery of the ring roll and a pressing washer engaging with the other end face of the ring roll; a roll compressing tool extractably fitted on the projected outer end of the tension member and provided with a hydraulic piston-cylinder, the roll compressing tool having a nut member threadedly fitted on the circumference thereof; crown splines formed on the outer peripheries of the nut member and pressing washer; and an extraction ring having a crown spline formed on the inner periphery thereof and slidably and fixably engageable with the crown splines of the nut member and pressing washer; the roll unit being attached to the roll compressing tool by the extraction ring and then mounted on the roll shaft by fitting and centering the tapered sleeve on the roll shaft while imparting tensile stress to the tension member by means of the hydraulic piston-cylinder; the hydraulic piston-cylinder applying to lateral sides of the ring roll a compressive force balancing with the tensile stress of the tension member to transmit torque from the roll shaft to the ring roll mainly by the frictional force produced by application of the lateral compressive force.

The above and other objects, features and advantages of the present invention will become apparent from the following description and appended claims, taken in conjunction with the accompanying drawings which show by way of example some illustrative embodiments of the invention.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
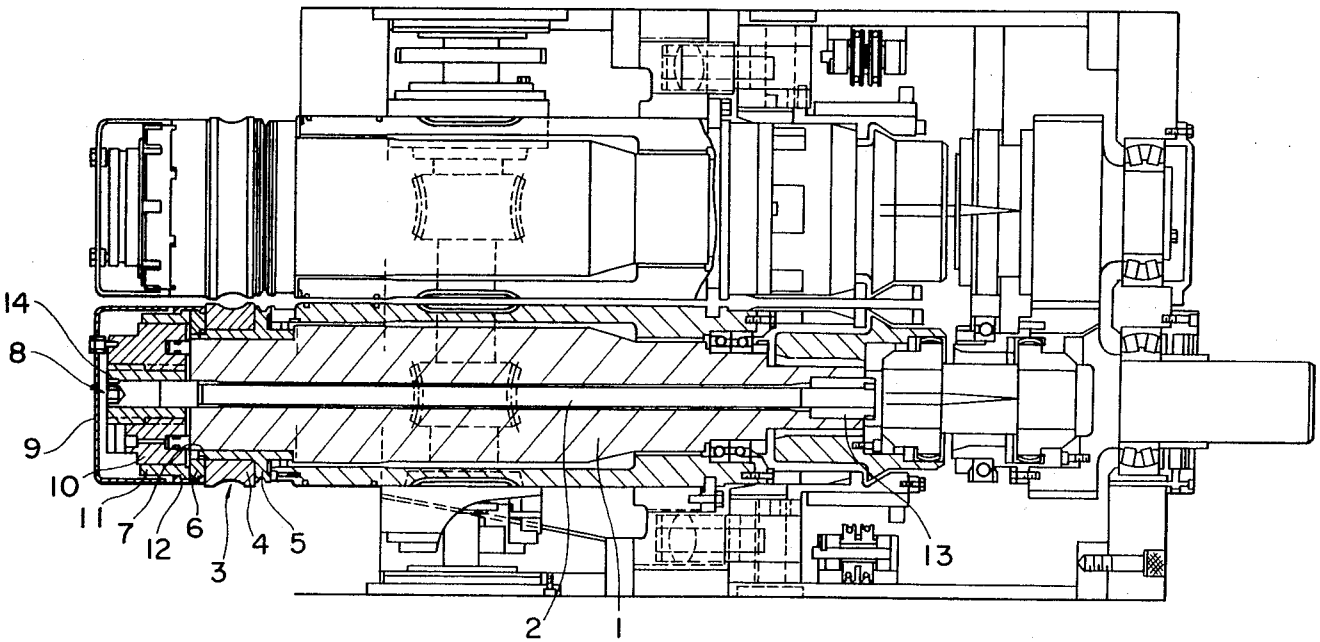
FIG. 1 is a partly cutaway side view of a cantilever type rolling mill incorporating a roll assembly according to the present invention.

Referring to the accompanying drawings and first to FIG. 1, there is shown a cantilever type rolling mill incorporating a roll assembly according to the present invention, in which indicated at 1 is a roll shaft, at 2 a round rod-like tension member loosely fitted in an axial hole 1*a* bored axially through the roll shaft 1, and at 3 a roll unit detachably mounted on the roll shaft 1 and having a ring roll 4 gripped between a pressing washer 6 and a one-piece or unitary tapered sleeve 5 integrally by means of a bolt 7. Designated at 8 is a roll compressing tool for mounting and dismantling the roll unit 3 on and from the roll shaft 1, the roll compressing tool 8 consisting of a hydraulic piston-cylinder 10 with a piston 9 and a nut member 11 threadedly fitted on the outer periphery of the cylinder 10. Indicated at 12 is an extraction ring interlocking the roll unit 3 with the roll compressing tool 8, and at 20 a replacing jig which is detachably engageable with the cylinder 10 of the roll compressing tool.

A nut 13 is fixedly threaded on a driving end of the above-mentioned tension member 2 to prevent its extraction from the roll shaft 1. The other end of the tension member 2 projects out of the end of the roll shaft 1 with a crown spline 14 fixedly mounted on the projected end by screws.

The roll unit 3 is provided with inwardly diverging tapered surfaces on the opposite end faces 4*a* and 4*b* of the ring roll 4. The ring roll 4 is further tapered on its inner peripheral surface 4*c*. On the other hand, the tapered sleeve 5 is tapered on its outer peripheral surface 5*a* which is fitted in the ring roll 4, and provided with a tapered flange 5*b* on the side of the roll for abutting engagement with the inner end face of the ring roll. The inner peripheral surface 5*c* of the sleeve 5 is so shaped as to fit on the outer periphery of the roll shaft 1. The outer end face 4*b* of the ring roll 4 is abutted against a tapered inner end face 6*a* of the pressing washer 6, which is provided with an inwardly projected stepped wall portion 6*b* at the outer and thereof. The roll unit 3 which is constituted by the above-described ring roll 4, tapered sleeve 5 and pressing washer 6 is assembled into a unitary structure by fitting the ring roll 4 and pressing washer 6 on the tapered sleeve 5 and threading and tightening the bolt 7 into the tapered sleeve 5 through the stepped wall portion 6*b* of the pressing washer 6 while holding the opposite end faces of the ring roll 4 in abutted engagement with the flange portion 5*b* of the tapered sleeve 5 and the inner end face 6*a* of the pressing washer 6. Further, splines 5*d* and 6*c* are formed on the inner peripheral surface at the outer end of the tapered sleeve 5 and on the inner peripheral surface of the stepped wall portion 6*b* of the pressing washer 6, respectively. These splines 5*d* and 6*c* are meshed with a spline 1*b* which is formed on the circumferential surface at the outer end of the roll shaft 1 to thereby permit transmission of torque from the roll shaft 1 to the roll unit 3.

The roll compressing tool 8 is provided with an axial bore 10*b* with a spline 10*a* centrally of the cylinder 10 in slidable meshing engagement with the crown spline 14 fixed on the tension member 2, and an annular groove 10*d* which is opened at the inner end on the side of the roll for receiving therein an annular piston 9. An oil pressure passage 10*g* is formed in the cylinder 10 to communicate the annular groove 10*d* with an oil pressure port 10*f* which is provided in the outer end face 10*e* remote from the roll and which is connectible to a hydraulic circuit (not shown). An external screw 10*h* is provided on the circumference of the cylinder 10 to mount a nut 11 thereon. The nut 11 is provided with a crown spline 11*a* in an inner end portion of its circumferential surface. Similarly, a crown spline 6*d* is formed in an outer end portion on the circumference of the pressing washer 6. The crown splines 6*d* and 11*a* are slidably meshed with a female crown spline 12*a* which is formed on the inner periphery of the extraction ring 12. After fitting the extraction ring 12 by meshing its crown spline 12*a* with the crown splines 6*d* and 11*a* and shifting the same toward the nut 11, it is locked against extraction from the pressing washer 6 upon turning it through an angle corresponding to the width of the spline.

Figure 2:
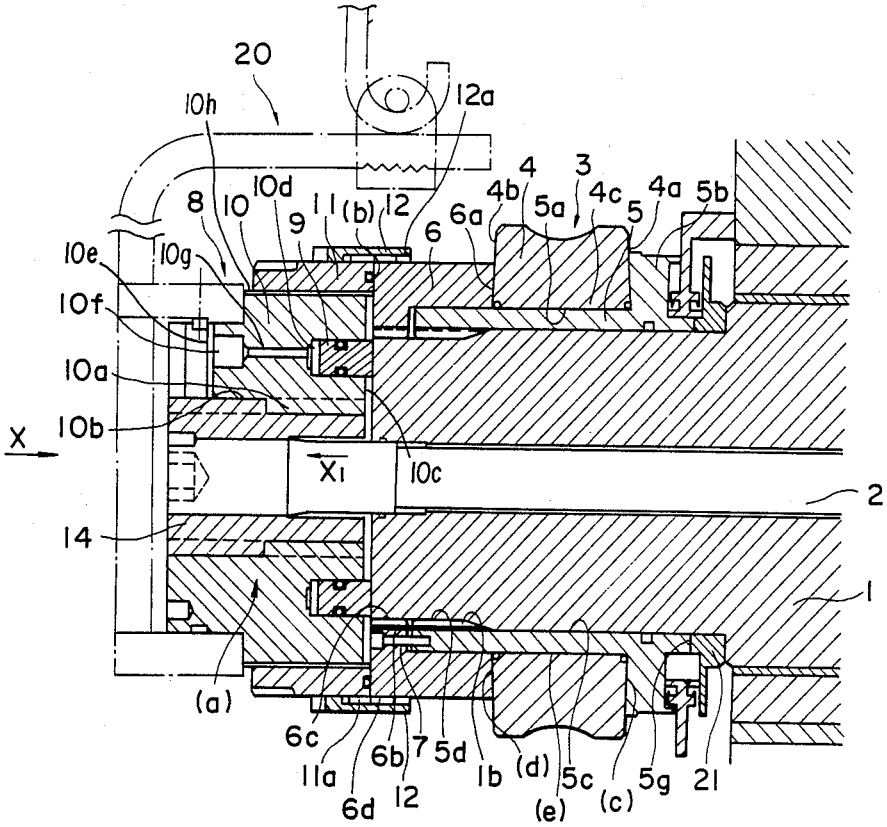
FIG. 2 is an enlarged sectional view of the roll assembly in FIG. 1.

With regard to the procedures for mounting the roll, the roll unit 3 which has been assembled into a unitary structure beforehand is mounted on the roll compressing tool 8 by the use of the extraction ring 12, and then the roll unit 3 and roll compressing tool 8 are fitted onto the roll shaft 1 by means of the roll replacing jig 20 which is mounted on the roll compressing tool 8, thereby fitting the tapered sleeve 5 of the roll unit 3 on the roll shaft 1 and at the same time pushing in the spline 10*a* of the cylinder 10 until a gap space (a) is formed between the spline 10*a* and the crown spline 14 fixed on the tension member 2 as shown particularly in FIG. 2. Thereafter, the cylinder 10 is turned through an angle corresponding to the width of the spline 10*a* to prevent extraction of the roll compressing tool 8 from the tension member 2. Next, after loosening the nut 11, the extraction ring 12 is shifted toward the nut 11, and then a hydraulic hose (not shown) is connected to the oil pressure port 10*f* to feed oil pressure to the annular groove 10 to push the piston 9 toward the roll shaft 1.

Figure 4:
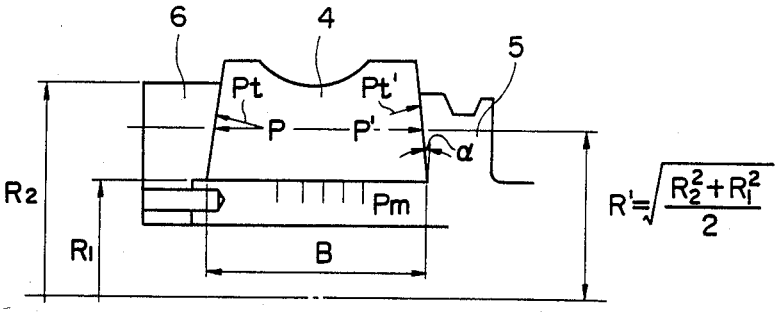
FIG. 4 is a diagrammatic view explanatory of transmitted torque.

As a result, the piston 9 is protruded beyond the inner end face 10*c* of the cylinder to stretch the tension member 2 in the direction of arrow Xl, forming a gap space (b) between the nut 11 and pressing washer 6. Nextly, the nut 11 is tightened until the gap (b) comes to nought, and thereafter the oil pressure is drained, whereupon the tension member 2 is contracted and the taper sleeve 5 of the roll unit 3 is pushed into the roll shaft 1, abutting the inner end 5*g* of the sleeve 5 against a member 21 which is fitted on the roll shaft 1. By repeating the above-described procedures again, including pressurization of the piston 9, tightening of the nut 11 and extraction of the oil pressure, a tensile stress corresponding to a preset oil pressure remains in the tension member 2 which is in a position balancing with the compressive force imposed by the nut 11, pressing washer 6, ring roll 4 and tapered sleeve 5. When assembling the roll unit 3 onto the roll shaft 1, the clearance around the inner tapered portion 4*c* of the ring roll 4 is brought to nought upon pushing in the tapered portion 5*a* of the tapered sleeve 5, simultaneously centering the roll shaft 1 and ring roll 4 relative to each other. With the ring roll 4 mounted on the roll shaft 1 in the above-described manner, rotation of the roll shaft 1 is transmitted to the roll unit 3 through the spline 1*b* at the fore end of the roll shaft 1 and splines 5*d* and 6*c* of the taper sleeve 5 and pressing washer 6, respectively, and to the ring roll 4 by the frictional force at the contact portions (c) and (d) on the opposite end faces 4*a* and 4*b* of the ring roll 4 with the tapered sleeve 5 and pressing washer 6, rotating the ring roll 4 mainly by compressive laterally acting pressure. At the same time, rotation is transmitted by an internal pressure acting at the contact portion (e) between the inner periphery of the ring roll 4 and the circumference of the tapered sleeve 5. The torque Tt transmitted by the above-mentioned laterally acting pressure and the torque Tr transmitted by the internal pressure are expressed by the following equations:

$$Tt = \mu R'(P_t + P'_t) = \frac{\mu(P + P')}{\cos\alpha} \times \sqrt{\frac{R_2^2 + R_1^2}{2}}$$

$$Tr = \pi\mu\beta\delta \times \left(\frac{R_2^2 + R_1^2}{R_2^2 - R_1^2} \times \frac{1}{E_1} + \frac{1}{E_2} + \frac{r_1}{E_1} + \frac{r_2}{E_2}\right)$$

wherein, as shown in FIG. 4,

P: a pressure applied by the tension member 2;

$\mu$: a frictional coefficient between the ring roll 4 and the sleeve 5 and pressing washer 6;

$\delta$: interference, at r1 caused by pushing-in of the tapered sleeve 5;

$E_1$: vertical elastic modulus of the tapered sleeve 5;

$E_2$: vertical elastic modulus of the ring roll 4;

$R_1$: Poisson's ratio of the tapered sleeve 5; and $R_2$: Poisson's ratio of the ring roll 4.

The total torque which is transmitted to the ring roll 4 is expressed by T=Tt+Tr. In the case of an ultra hard roll, it is preferred that $T \geqq 0.5$ Tr (Tr=0.1–0.5 T) in consideration of its thermal expansion coefficient which is about ½ that of steel, increases in interference caused by temperature elevation, and its smaller tensile stress as compared with its compressive stress.

During the above-described torque transmission, weakening of the compressive force which is exerted to the ring roll 4 is prevented by the pushing force of the nut 11, and the tension member 2 applies a stable clamping force, free of extensions or contractions during the torque transmission.

Figure 5:
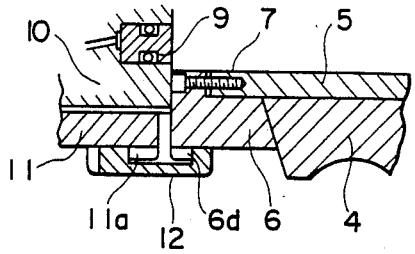
FIG. 5 is a fragmentary sectional view employed for explanation of disassembly procedures.
Figure 3:
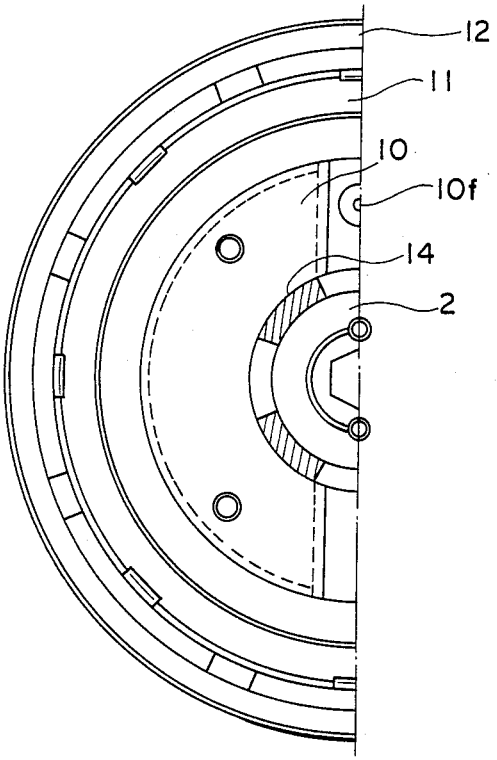
FIG. 3 is a view taken in the direction of arrow X in FIG. 1.

In order to detach the roll unit 3 from the roll shaft 1, a hydraulic hose is connected to the oil port 10*f* of the roll compressing tool 8, and in a pressurized state the nut 11 is loosened to set the extraction ring 12 as shown in FIG. 5. Then, the oil pressure is extracted and the nut 11 is loosened again, whereupon the ring roll 4 can be dismantled from the roll shaft 1 together with the tapered sleeve 5 and pressing washer 6, permitting detachment of the roll compressing tool 8 and roll unit 3 simultaneously.

As is clear from the foregoing description, the roll assembly for a cantilever type rolling mill according to the invention essentially includes a tension member provided axially within a roll shaft and imparted with a tension stress by a roll compressing tool incorporating a hydraulic piston-cylinder, and a pressing washer and a tapered sleeve which are adapted to apply on the opposite lateral sides of a ring roll a compressive force balancing the tension stress of the tension member to transmit torque to the ring roll mainly by the frictional force resulting from application of lateral pressures, to preclude the problem of ring cracking which is experienced in the conventional rolls which are designed to transmit torque solely by frictional force on the inner surface of a ring roll. The torque transmission by application of a lateral compressive force is also advantageous to a ring roll consisting of an ultra hard roll which is more suited to compressive stress, and in such a case it is possible to transmit a high torque to a roll of a relatively small diameter and thus to reduce the prime unit and cost of rolls advantageously.

Referring now to FIGS. 6 to 9, there is shown another embodiment of the present invention incorporating a coupling head support mechanism which is adapted to support the coupling heads of a roll stand in horizontal state upon extraction of a roll to facilitate replacement of a roll or roll unit. More specifically, indicated at 101 is a spindle casing which is constituted by an end bearing plate 102, an intermediate bearing plate 103, a circumferential casing 104 and a connecting end plate 105. Designated at 106 is a roll unit casing which is detachably secured to the spindle casing 101, the roll unit casing 106 having a circumferential casing 109 between a lock receptacle plate 107 provided at one end in abutting engagement with the connecting end plate 105 and a bearing end plate 108 provided at the other end thereof.

Denoted at 110 are two sets of lock levers which are opposingly provided internally at one end of the spindle casing 101 and are disengageably engageable in lock grooves 112 in the lock receptacle plate 107 upon actuation of a lock cylinder 111. Reference numeral 113 indicates upper and lower cylindrical cartridges which are mounted between the lock receptacle plate 107 and bearing end plate 108, each cartridge having around its circumference a worm wheel 114 in meshed engagement with a respective driving worm which is located on one side, to thereby move roll shafts 116 which are fitted eccentrically in the respective cartridges 113 toward or away from each other to adjust the pass clearance between a pair of working rolls as will be described in greater detail hereinbelow.

In this sort of coupling head assembly, a coupling end portion 119 with a male spline 118 around its circumference is usually provided at the inner end of each roll shaft 116 remote from the working roll, and the eccentric cartridge 113 is rotatably mounted on the roll unit casing 106 through a stationary extraction blocking plate 120 which prohibits movements in the axial direction.

On the other hand, the spindle casing 101 is provided with upper and lower bearing members 121 in the end and intermediate bearing plates 102, 103 to support therein a drive spindle 122 and an interlocking gear 123, respectively. The lower drive spindle 122 is coupled with a rotational drive system (not shown), to rotate a drive gear 124, which is provided around the circumference of the spindle 122, and the interlocking gear 123. Rotated with these gears 123 and 124 is a concentric rotation type horizontal coupling 125 which is supported in the intermediate bearing plate 103 and which is formed with an inner spindle gear 126 around the inner periphery of its one end for meshing engagement with a variable angle type outer spindle gear 127 of a first gear coupling 128 with a movable spindle 129 as its center shaft. Mounted at the other end of the spindle 129 is a second gear coupling 130 which is provided with a coupling head 131 to mesh its outer spindle gear 127 (a transmission part) and inner spindle gear 126 (a transmission part) with each other. A female spline 132 which is formed on the inner periphery of the head 131 is extractably engaged with the aforementioned male spline 118. In this instance, the ends of the splines 118 and 132 are formed in a diverging or converging form to ensure smooth engagement.

The upper and lower transmission mechanisms for the upper and lower roll shafts are constituted by the same coupling means as described above. According to the present invention, there is further provided a coupling head support mechanism in this sort of cantilever type rolling mill to support a coupling head automatically in horizontal state upon extraction of a roll to obviate the laborious jobs which would otherwise be required.

Figure 7:
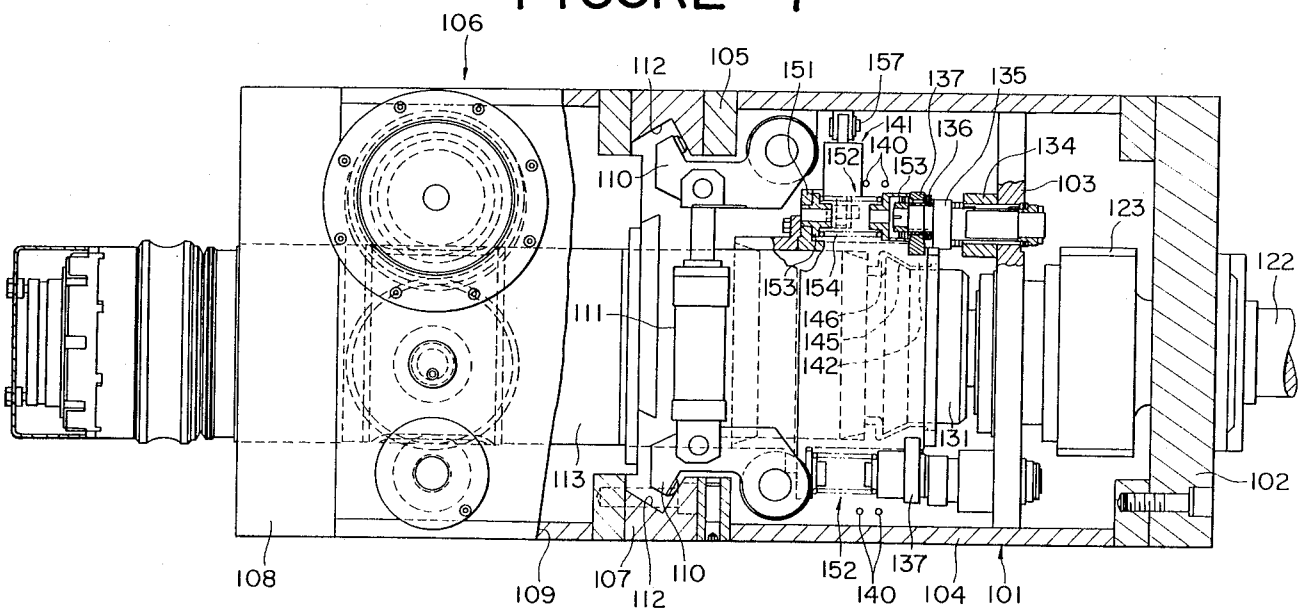
FIG. 7 is a view taken in the direction of arrow VII in FIG. 6.
Figure 8:
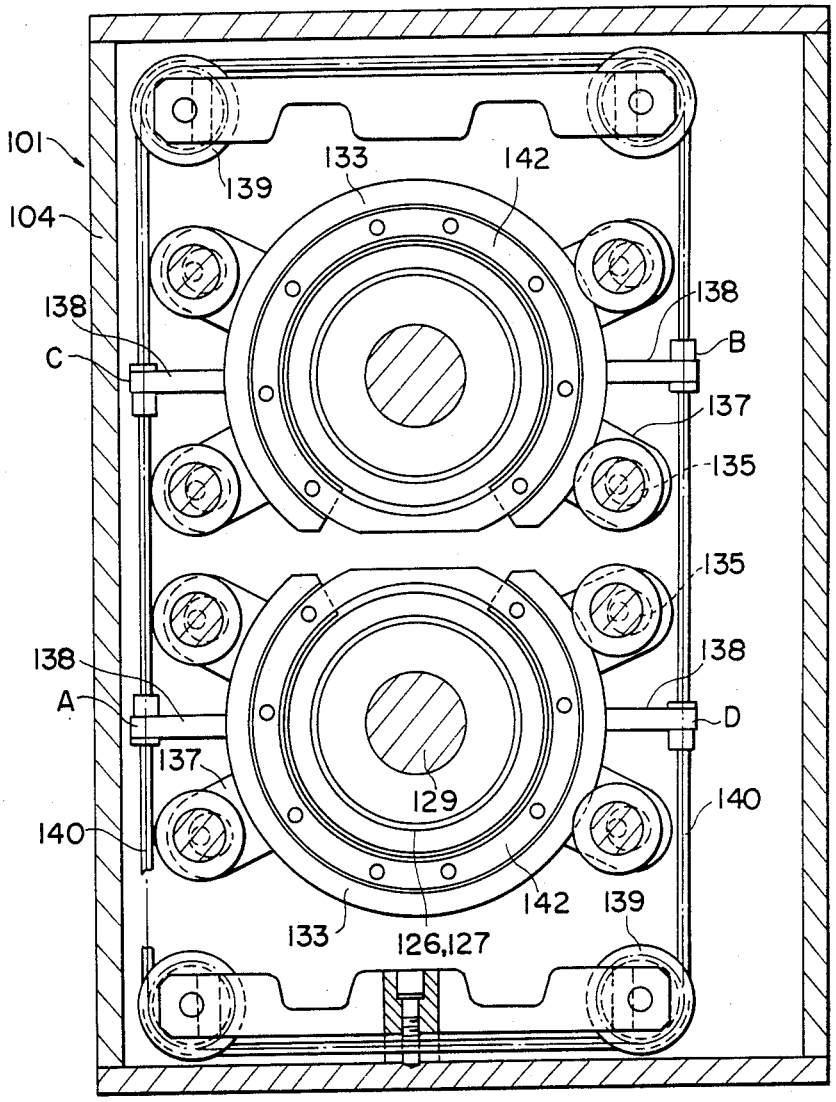
FIG. 8 is a sectional view taken on line VIII—VIII of FIG. 6.

More specifically, the coupling head support according to the invention includes a couple of balancing holder frames 133 which are disposed to circumvent the respective coupling heads 131 and which are each constituted, as shown particularly in FIG. 8, by an annular body with a notched portion on the upper or lower side. As illustrated particularly in FIG. 7, these holder frames 133 are each supported by four eccentric shafts 135, which are mounted at four spaced position on the intermediate bearing plate 103 through base bearings 134, through four support arms 137 to permit eccentric rocking movement of each holder frame 133 along a predetermined eccentric locus under guidance of the eccentric shafts 135.

The upper and lower holder frames 133 are provided with arms 138 at two horizontally opposing position on the circumference thereof, the fore ends of the arms 138 are connected to balancing links 140 at four different points as indicated at A to D in FIG. 8, which balancing links 140 being passed around tension wheels 139 fixedly mounted in four spaced positions on the inner wall surface of the spindle casing 101, in the following manner. Namely, a wire rope which constitutes one balancing link 140 is connected to the arms 138 at points A and B, while the other balancing link 140 is connected to the arms 138 at points C and D. By this arrangement of the balancing mechanism, the holder frame 133 and a supported member, which will be explained herein after, are held in a balanced state during extraction or insertion of roll shafts. This balancing is also effected in cooperation with a resilient retainer 141 shown in FIG. 9 in a manner as will be described hereinbelow.

The support mechanism of the present invention is characterized in that head holders 142 of a substantially cylindrical shape are retractably fitted in the holder frames 133 with the above-described balancing system, the head holders 142 being movable over a predetermined stroke length limited by a stopper groove 144, thereby to temporarily support the coupling heads 131.

To explain this feature in greater detail, the coupling head 131 is provided with an inner clasp portion 145 projecting in a tapering fashion from its circumference, and an outer clasp portion 146 projecting in a similar shape from the inner periphery of the head holder 142. These clasp portions are forcibly disengaged from each other in the state of FIG. 5 by a separating means which is constituted by a pusher member 147 projecting from one end of each bearing housing 113 and an abutting member 148 (a flange) projecting from the inner periphery of the head holder 142 opposingly to the pusher member 147. In this instance, the pusher and abutting members 147 and 148 are provided with tapered centering guide means 149 and 150, respectively, at the fore ends thereof for guiding and controlling the coupling head 131 and roll shaft 116 in concentric relation with each other as will be described hereinafter.

Although the head holder 142 is in a disengaged state as described above during driving operation, it is urged into an operating position to retain the coupling head 131 in a horizontal posture when a roll shaft 116 is extracted, by means of an automatic biasing means in the manner described as follows.

Figure 9:
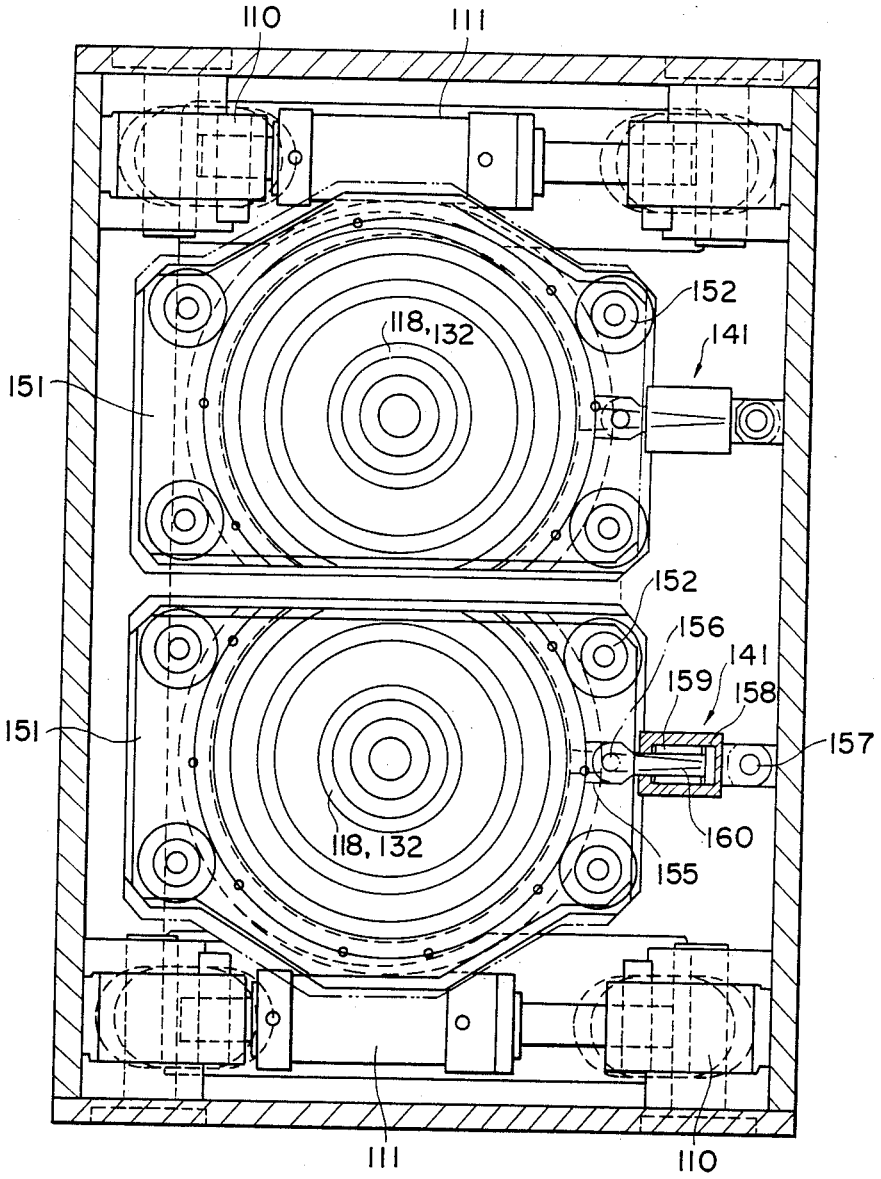
FIG. 9 is a sectional view taken on line IX—IX of FIG. 6.

As illustrated particularly in FIG. 7, the biasing means is constituted by coil spring type holder biasing means 152 which are interposed between a spring seat flange 151 projectingly provided at one end of the head holder biasing means 152 which are interposed between a spring seat flange 151 projectingly provided at one end of the head holder 142 and opposing arms 138. In this instance, a compression spring 154 is interposed between a pair of spring washers 153 which are provided in the axial direction. Accordingly, upon recession of the pusher member 147, the head holder 142 is urged toward the roll by the resilient force of the spring 154 to engage the aforementioned tapered portions for supporting the head 131. An inner bracket 155 is projectingly provided on the outer periphery of the head holder 142 as shown iupporting the head 131. An inner bracket 155 is projectingly provided on the outer periphery of the head holder 142 as shown in FIGS. 7 and 9 and connected to the above-mentioned resilient retainer 141 through a pin 156. The resilient retainer 141 is constituted by a pivoting pin 157, a spring holder 158, a compression spring 159 and a resilient pull shaft 160, and adapted to urge the holder frames 133 automatically into a median point between eccentric dead center positions to which the holder frames 133 as a whole would otherwise tend to move by eccentric motion of the eccentric shafts 135 upon extraction of rolls, thereby lightly and smoothly guiding the holder frames 133 at the time of roll insertion.

Thus, with the above-described arrangement, the lock lever 110 is released by the lock cylinder 111 to render the roll unit separable from the spindle casing 101, permitting dismantiling of the roll unit by the use of a crane or other suitable means.

Figure 6:
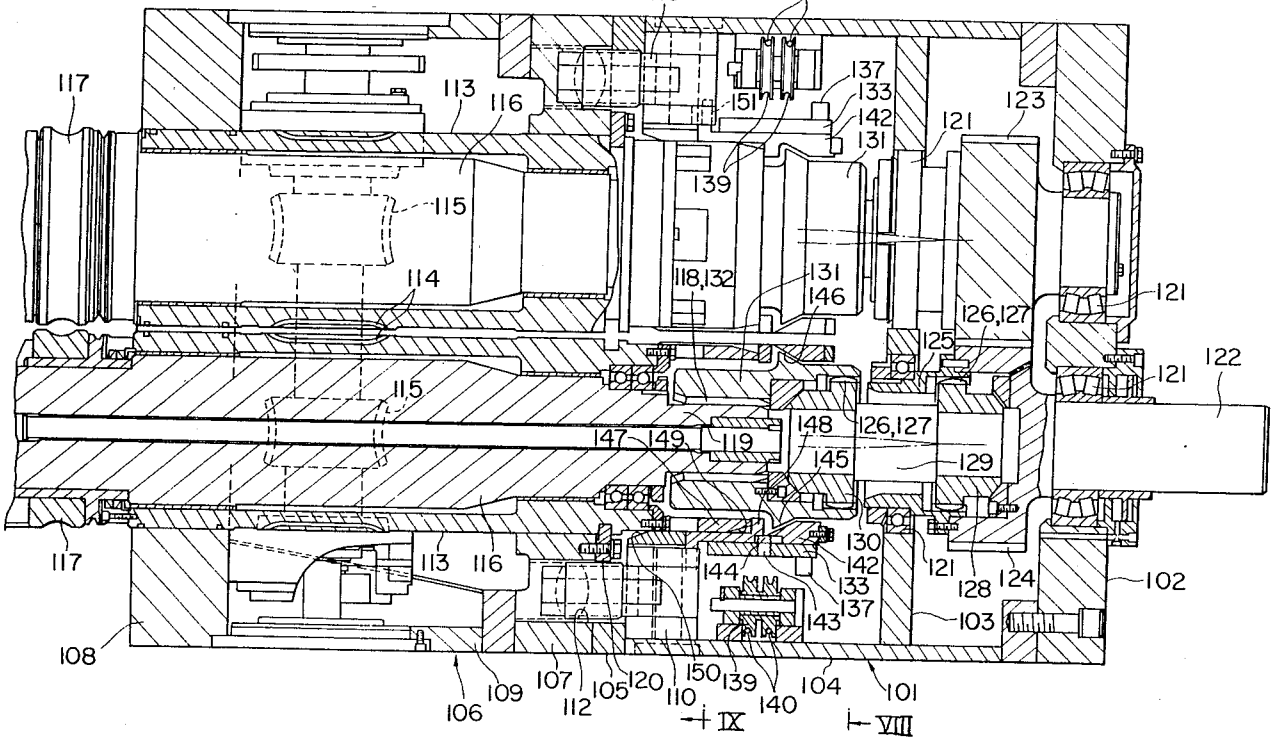
FIG. 6 is a vertically sectioned side view of a cantilever type rolling mill incorporating a coupling head support mechanism according to the present invention.

Upon initiating separation of the roll unit, the coupling end portion of the roll shaft 119 is moved away from the coupling head 131, receding therewith the pusher member 147, so that the head holder 142 which is biased by the coil springs 142 in the leftward direction in FIG. 6 is accordingly moved leftward over a predetermined distance until the inner and outer clasp portions 145 and 146 are brought into tapered fitting. This is securely guided by the sliding movement of the head holder 142 in the holder frame 133, so that the coupling head 131 is retained as it is in the original horizontal position. Of course, not only the coupling head 131 but also the head assembly from the coupling head 131 to a member located immediately before the drive spindle 122 is retained in the original position.

In this retained state, the original positure is maintained by the above-described balancing action and the attraction of the resilient pulling force, namely, by the vertical balancing action of the balancing links 140 and by the concentric return action of the resilient retainer 141.

In this manner, the coupling head is automatically retained optimally in the original posture throughout the roll extracting and inserting operation without any addition operations. In addition to this very significant advantage, upon inserting and engaging again the interlocking shaft end 119 at the time of roll replacement or the like, the pusher member 147 is forcibly urged into a concentric position under the tapered guide of the head holder 142 and then, due to the concentricity of the pusher member 147 relative to the head holder 142, the coupling roll end 119 can be smoothly fitted into the coupling head 131. Upon fitting the coupling roll end 119 in this manner, the abutting member 148 is depressed by the pusher member 147 to return the head holder 142 into the initial retracted position of FIG. 1 to position the coupling head in an operable state. Of course, the lock lever 10 is set in the locking position after disengagement of the head holder 142.

Figure 10:
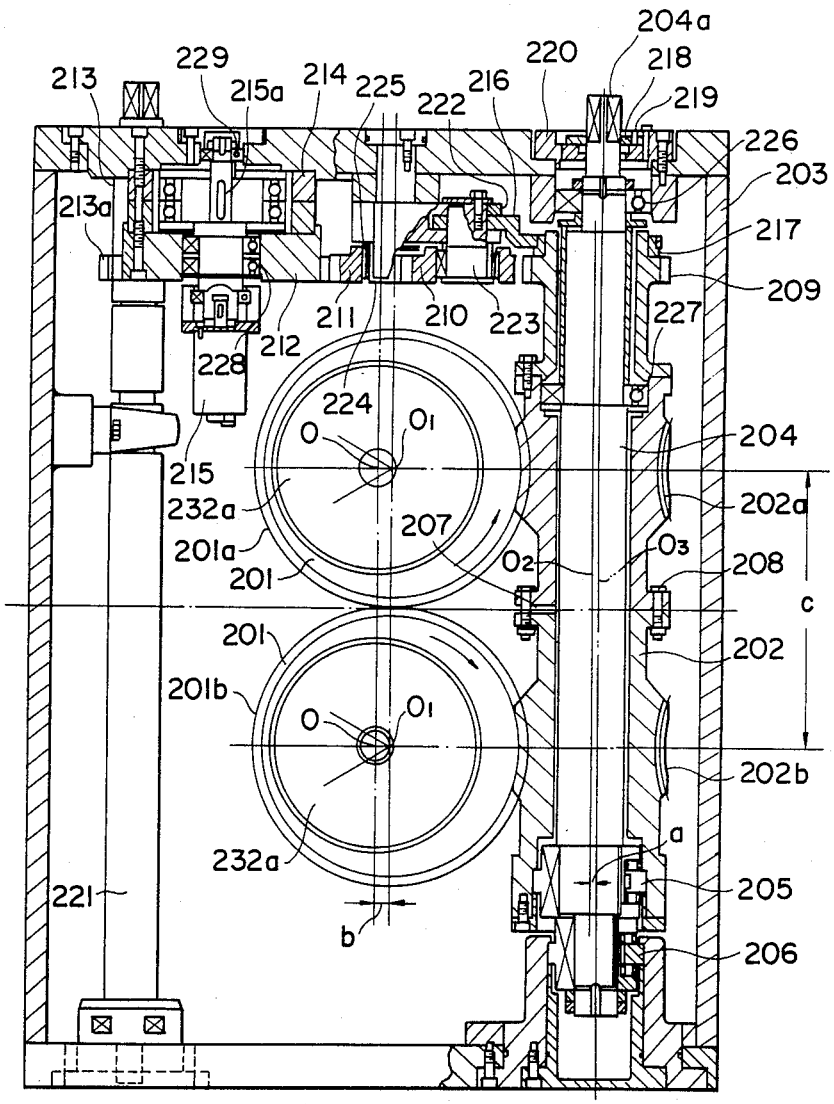
FIG. 10 is a vertically sectioned side view of a cantilever type rolling mill incorporating a pass clearance adjusting mechanism according to the invention.
Figure 11A:
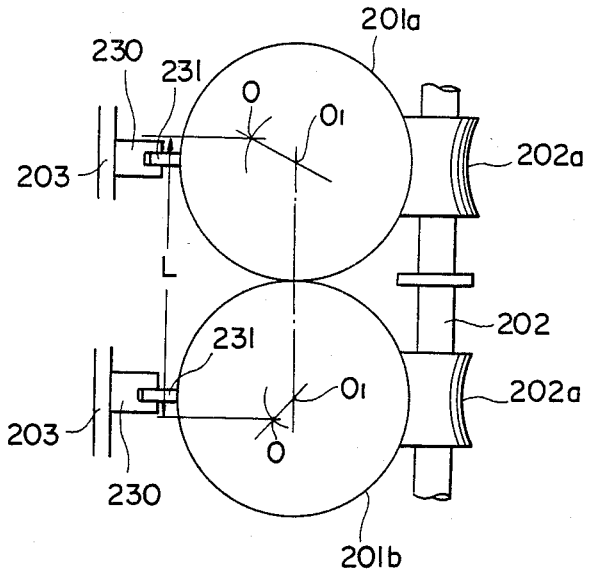
FIGS. 11(*a*) and 11(*b*) are diagrammatic views showing details of guide members.
Figure 11B:
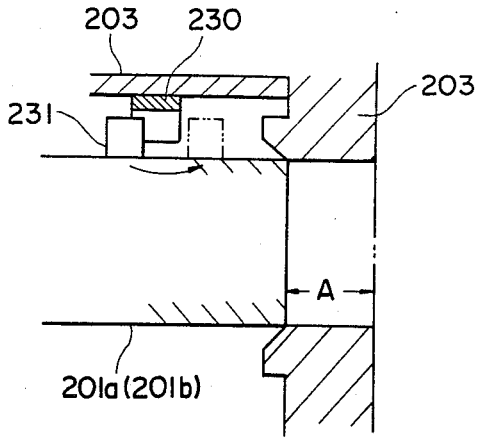

Referring now to FIGS. 10 and 11, there is shown a rolling mill incorporating a screw down mechanism according to the present invention, which permits easy assembly and disassembly of cartridges wherein indicated at 232 are a pair of working rolls which are projected on one side of a roll housing 203 and supported on cantilever type roll shafts 232*a*, which are rotatably supported in the roll housing 203 and are separable in the manner well known in the art into a shaft portion for supporting working roll 232 and a shaft portion with a drive gear 233. On the roll shaft portions which support the rolls 232, a pair of eccentric cartridges 201 of known construction are extractably fitted from the front side of the roll housing 203 on the side of the rolls 232, so that, upon turning the cartridges 201, the rolls 232 are turned in the same direction, varying the clearance between the opposing rolls 232 due to eccentricity of the axial centers 0 of the rolls relative to the centers 01 of the eccentric cartridges. When the rolls 232 are rotated through the roll shafts 232*a* for rolling operation, the eccentric cartridges 201 are both blocked against rotation by suitable locking means.

As means for rotating the eccentric cartridges 201 for the adjustment of the pass clearance (or variation of screw down gage), the present invention employs cylindrical worm wheels 201*a* and 201*b* which are integrally and opposingly positioned on the circumferences of the cylindrical eccentric cartridges 201 as exemplified in FIG. 10. In the particular example shown, the eccentric cartridges 201 are illustrated as having substantially the same outer diameters as the worm wheels since it is possible to minimize the flexure of roll shafts and improve the rigidity of the mill by increasing as much as possible the outer diameters of the eccentric cartridges 201 and of the roll shafts 232*a* received in the respective cartridges.

In the particular embodiment shown, a hollow worm shaft 202 is employed in order to drive the worm wheels 201*a* in such a manner as to synchronously rotate the two eccentric cartridges 201, as shown in FIG. 10. The hollow worm shaft 202 is provided with worms 202*a* and 202*b* on the circumference thereof, in meshing engagement with the worm wheels 201*a* and 201*b*, respectively. For this purpose, the hollow worm shaft 202 is located perpendicularly to the axis of the eccentric cartridges 201 on one side thereof, and an operating shaft having a center 03 in an eccentric position relative to the center 02 of the hollow worm shaft 202 is rotatably fitted in the later through a bearing 227 and a needle thrust radial bearing 205. Further, an upper portion of the operating shaft 204 is rotatably supported in a journal portion in an upper portion of the roll housing 203 through a bearing 226. A head portion 204*a* of the operating shaft 204 is projected above the upper surface of the roll housing 203 through a ring 218, pin 219 and cover 220, while a lower portion of the shaft 204 is rotatably supported in a journal portion in a lower portion of the roll housing 203 through a needle radial thrust bearing 206, thereby retaining the operating shaft 4 in position. Indicated by reference character (a) is the extent of eccentricity of the center 03 of the operating shaft 204 relative to the center 02 of the worm shaft, and by (c) the distance between the centers of the eccentric cartridges 201.

For rotating the hollow worm shaft 202, a gear 209 is provided in an upper portion of the worm shaft 202 as exemplified in FIGS. 9 and 10, in series with an idle gear 210 meshing with the gear 209 and another idle gear 211 meshing with the idle gear 210. In this instance, a shaft 224 which mounts thereon the idle gear 211 through a bearing 225 is journalled on the roll housing 203 and pivotally supports thereon a lever 222. A shaft 223 for the idle gear 210 is supported by the lever 222 and another lever 216 which is mounted on the gear 209 through a bush 217 for maintaining a predetermined interlocking relationship of the gears 209, 210 and 211 even when the hollow worm shaft 202 is rotationally displaced through the eccentric operating shaft 204 as will be described in greater detail hereinlater. The idle gear 211 is meshed with a gear 212 which is rotatably supported through a bearing 228 on a drive shaft 215*a* of a hydraulic motor 215 which serves as an automatic operating means. The aforementioned gear 212 is meshed with a pinion 213*a* which is driven by a pinion shaft 213 or a screw-down shaft 221 which serves as manual operating means. Mounted on the drive shaft 215*a* of the hydraulic motor 215 is a reducer 214 through which the gear 212 is driven from the hydraulic motor 215. The driveability through either the pinion shaft 213 or the screw-down shaft 221 makes the mechanism applicable to both vertical and horizontal rolling mills, permitting operations from either the upper or lower side, whichever may be suitable.

Accordingly, in order to manually operate the above-described rotating means, either the pinion shaft 213 or screw-down shaft 221 is rotated in a forward or reverse direction, whereupon the gear 209 is rotated in a forward or reverse direction through pinion 213*a* and gears 212, 211 and 210 to rotate the hollow worm shaft 202. As a result of rotation of the hollow worm shaft 202, the worm wheels 201*a* and 201*b* are rotated through predetermined angle by the worms 202*a* and 202*b* which have opposite helix angles, thereby widening or narrowing the clearance between the working rolls 232 to permit adjustment of the reduction rate in a facilitated manner. On the other hand, in the case of an automatic operation, upon actuating the hydraulic motor 215 is actuated in a forward or reverse direction, the gears 212 and 211 are rotated through the reducer 214 to rotate the gear 209 in a forward or reverse direction. Similarly, through the hollow worm shaft 202, worms 202*a* and 202*b* and worm wheels 201*a* and 201*b*, the eccentric cartridges 201 are rotated to arbitrarily adjust the roll clearance or reduction rate in the same manner. In this case, it is possible to operate the motor 215 by remote control. The reduction force is represented by the turning moment of the extent of eccentricity (b) of the centers 0 of the working roll from the centers 01 of the respective cartridges, so that the worms 202*a* and 202*b* are located on the compression side.

In order to extract the eccentric cartridges 201 from the roll housing 203, the operating shaft 204 which is eccentrically inserted in the hollow worm shaft 202 is turned through 180°. By so doing, the worms 202*a* and 202*b* are rotated together with the hollow worm shaft 202 and at the same time moved away from the worm wheels 201*a* and 201*b* by a distance corresponding to twice the extent of eccentricity (a), disengaging from the worm wheels 201*a* and 201*b*, respectively. At this time, the idle gear 210 which is pivotally supported on the two levers 216 and 222 retains the same position relative to the gears 209 to 212 without breaking the above-described interlocking relationship of the gear train. Consequently, as mentioned hereinbefore, upon freeing the worm wheels 201*a* and 201*b*, the eccentric cartridges 201 can be promptly and easily extracted from the roll housing 203. In addition, even if the worms 202*a* and 202*b* are turned when the eccentric cartridges 201 are inserted again into the roll housing 203 after repair in a disassembled state, they can be adjusted through the gear train 213*a* to 209 simply by turning the pinion shaft 213 or the screw down shaft 221. Accordingly, after insertion of the eccentric cartridges 201, when the hollow worm shaft 202 is turned closer to the cartridges through rotation of the operating shaft 204 for engaging the worms 202*a* and 202*b* with the worm wheels 201*a* and 201*b*, respectively, it is possible to shift the worm positions easily to avoid interference of opposing teeth and to mesh them appropriately with the worm wheels. The eccentric cartridges 201 are disassembled from or assembled with the roll housing 203 in the maximum opening positions of the eccentric cartridges 201. In this connection, the phases of the two eccentric cartridges 201 may be matched by providing guide members 230 on the roll housing 203 which are engageable with guide members 231 on the part of the cartridges 201 as exemplified in FIGS. 11(*a*) and 11(*b*). In FIG. 11(*b*), the reference character A denotes a stroke for cartridge insertion.

According to the present invention, there is further provided a pass clearance (screw down) gage indicator for rolling mills employing a pair of eccentric cartridges for the adjustment of the roll clearance as described above. More specifically, the pass roll clearance indicator according to the invention includes, as shown in FIGS. 12 to 17, a cam lever 302 which is fixedly mounted on the circumference of one eccentric cartridge 301 and projected outward along a radial line passing through the center (c) of the cartridge 301, the cam lever 302 rotatably supporting a cam roller 303 at its fore end. The cam lever 302 is integrally turnable with the cartridge 301 and serves as a member for detecting the rotational angle of the cartridge 301.

Figure 12:
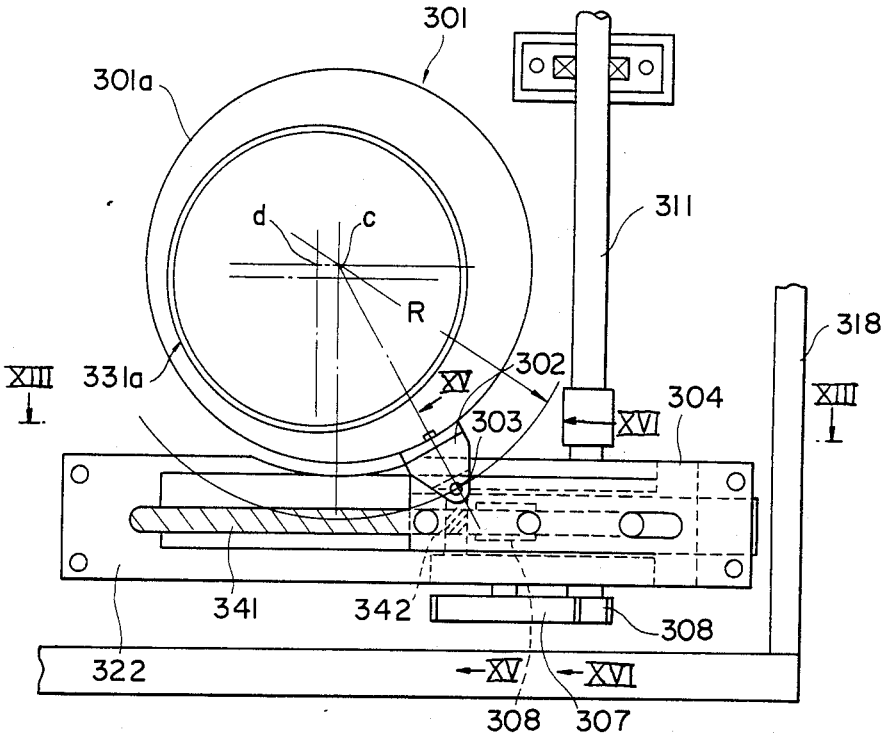
FIG. 12 is a diagrammatic view of a screw-down gage indicator according to the invention.
Figure 13:
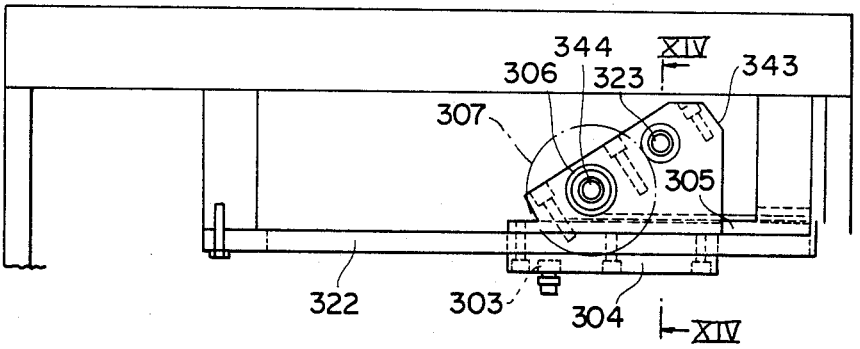
FIG. 13 is a view taken in the direction of line XIII—XIII in FIG. 12.

Opposingly to the cam roller 303 of the cam lever 302, there is provided a movable rack 305 on a fixed frame 322 for movement in a direction parallel with a line tangential to the eccentric cartridge 301 as shown in FIGS. 12 and 13. More specifically, a slide groove 341 is formed on a fixed frame 322 on a roll housing 318 in a direction parallel with a tangential line to the eccentric cartridge 301, and the rack 305 has its base portion 305*a* slidably fitted in the slide groove 341 with its lateral wing portions in contact with one side of the frame 322 as seen also in FIGS. 15 and 16. A cam guide 304 is securely fixed to the bottom end of the fitted base portion 305*a* of the rack 305, in contact with the other side of the frame 322, so that the rack 305 and cam guide 304 are integrally slidable on the frame 322 in a direction parallel with a line tangential to the eccentric cartridge 301. The cam guide 304 is provided with a vertical groove 342 for receiving therein the cam roller 303 of the cam lever 302. The rack 305 is mounted on the roll housing 322 such that a line connecting an axial center (c) of one cartridge 301 and an axial center (d) of the corresponding working roll 311 (coaxial with the roll shaft 331*a*) is disposed parallel with a line connecting an axial center (c′) of the other cartridge 301 and an axial center (d′) of the corresponding working roll 331 when a line connecting the axial center (c) and a center of the cam roller 303 of the cam lever 302 becomes perpendicular to the direction of movement of the rack 305 on the frame 322.

Figure 14:
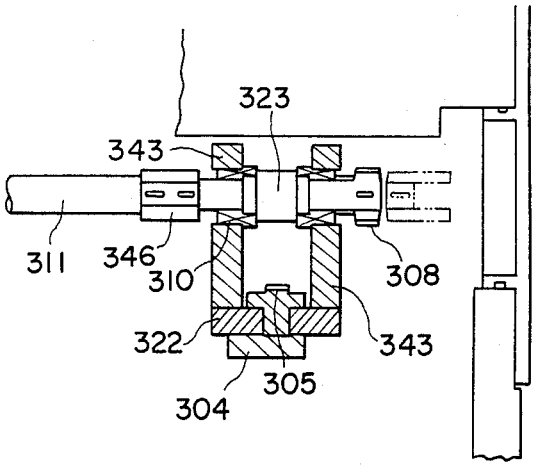
FIG. 14 is a sectional view taken on line XIV—XIV of FIG. 13.
Figure 15:
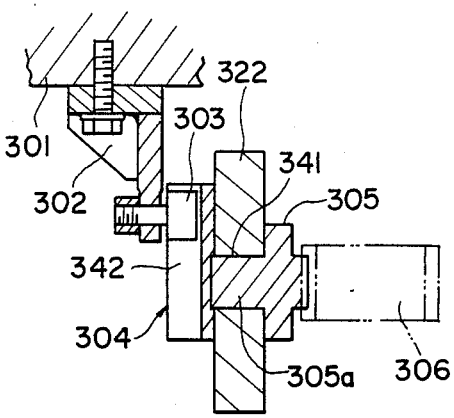
FIG. 15 is a sectional view taken on line XV—XV of FIG. 12.
Figure 16:
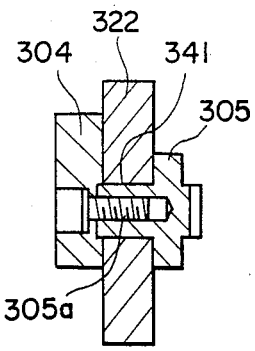
FIG. 16 is a sectional view taken on line XVI—XVI of FIG. 12.
Figure 17:
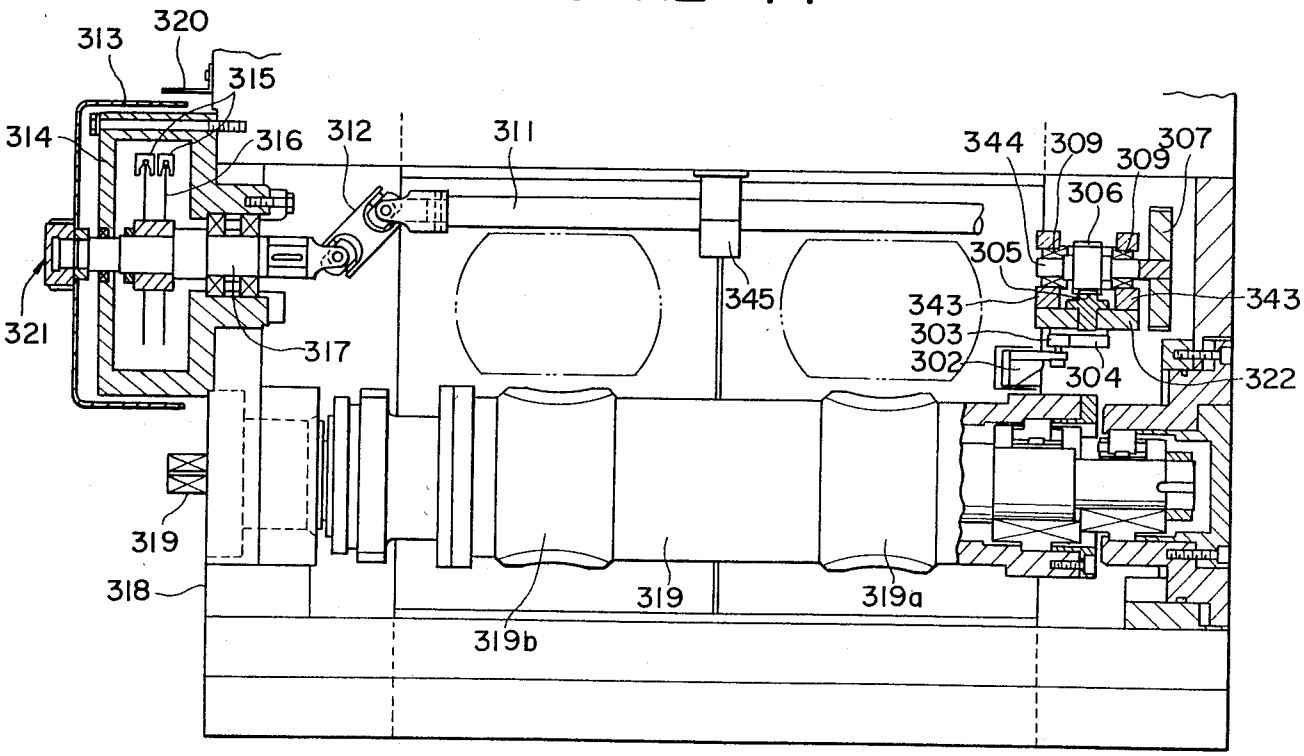
FIG. 17 is a sectioned side view showing major components of a rotary disc dial.

The fixed frame 322 which slidably holds the rack 305 is provided with a bracket 343 which is projected beyond the toothed face of the rack 305 as shown in FIGS. 12 to 14, mounting thereon a pinion shaft 344 through a bearing 309 for supporting a pinion 306 in meshing engagement with the teeth of the rack 305. Mounted on the pinion shaft 344 and a shaft 323 which is supported also on the bracket 343 separately from the pinion shaft 344 are intermeshed gears 307 and 308, respectively, which are provided for speed reduction or increase. The shaft 323 is connected through a coupling 346 to one end of a transmission shaft 311 which is rotatably on the roll housing 318 through a bearing 345 in the same direction as the shaft 323. The other end of the transmission shaft 311 is connected through a universal joint 312 to a rotary input shaft 317 of a rotary disc dial 313 which serves as an indicator. The reason for inserting the universal joint 312 between the rotary input shaft 317 and the connecting end of the transmission shaft 311 is to absorb deviations of center positions of the rotary disc dial 313 and transmission shaft 311, so that it may be omitted in a design where the dial disc 313 and transmission shaft 311 are positioned concentrically with each other. The dial disc 313 is rotatably provided rotatably in an upper portion of the roll housing 318 as shown in FIG. 17, supported on the projected outer end of the rotary input shaft 317. Although not shown, the dial disc 313 is provided with a scale on and around its circumferential surface, with graduations at uniform intervals to indicate the gage of the roll clearance or screw-down. Projected over the scale of the disc dial 313 is a pointer needle 320 which is fixed on a side wall of the roll housing as shown in FIG. 17. The reference numeral 321 denotes a nut which clampingly fastens the rotary input shaft 317 and rotary disc dial 313 together. Indicated at 315 is a photoelectric pulse pick-up built in the frame 314, which supports the rotary input shaft 317 and rotary disc dial 313, cooperating with a slit marker 316 which is opposingly mounted on the input shaft 317, for producing pulse signals indicative of angles of rotation of the eccentric cartridges 301 for use in remote control of the roll clearance gage.

With this roll clearance gage indicator, the cam lever 302 is rotated integrally with one eccentric cartridge 301 when the two eccentric cartridges 301 are turned automatically or manually for broadening or narrowing the roll clearance as described hereinbefore, moving therewith the cam roller 303 at the fore end of the cam lever 302 which is in engagement with the groove 342 on the cam guide 304 integrally fixed to the rack 305. Therefore, if the cam roller 303 at the fore end of the cam lever 302 is turned with the cartridge 301 along an arc having a radius R from the center axis (c) of the cartridge 301, the cam guide 304 and the rack 305 which is fixed to the guide 304 are moved linearly along the slide groove 341 in a direction tangential to the cartridge 301 by the cam roller 303 in engagement with the groove 342. By this movement of the rack 305, the pinion 306 and pinion shaft 344 on the frame 322 are rotated accordingly, transmitting the rotation to the shaft 323, transmission shaft 311 and rotary input shaft 317 through an overdrive (or reduction) gear 308 which is meshed with the gear 307 on the pinion shaft 314. As a result, the rotary disc dial 313 is rotated proportionally to the rotation of the eccentric cartridges 301 to register the pointer needle 320 on a graduation which corresponds to the actual gage of the roll clearance (or screw-down) between working rolls 331.

According to the present invention, there is further provided a roll caliber adjusting mechanism for each eccentric cartridge, which is arranged to permit axial movement of the cartridge for caliber adjustment and to press the cartridge in a radial direction against a roll stand during rolling operations.

As illustrated in FIGS. 18 to 22, the roll caliber adjusting mechanism includes a circumferential groove 437 of a trapezoidal shape in section, formed around the circumference of each eccentric cartridge 411 over a predetermined length on one side thereof, and a fitting member 438 disengageably fitted in the circumferential groove 437 and having tapered surfaces 439 on opposite sides for surfacewise contact with the tapered side walls of the circumferential groove 437. The fitting member 438 is fixed at the fore end of a pressing means 440 which is retractably protrudable in a radial direction of the eccentric cartridge 411.

In the particular example shown, the pressing means 440 is constituted by a hydraulic cylinder which is slidably fitted in a block member 441 of the roll housing 403. The block member 441 is provided with a bore 442 which is opened toward the cartridge 411 in a radial direction thereof, and a bush 443 fixed in the bore 442. Slidably fitted in the bush 442 is a cylinder tube 444 which is axially slidable and receives therein a piston 446 which is fixed to a piston rod 445. The piston rod 445 is fixed through a plate 447 to a worm presser 448 which is fixed to the block member 441 by a bolt 49 and provided with a bore 442. The inner end of the cylinder tube 444 is closed by an end plate 450 which is slidable with the piston rod 445. The piston rod 445 is provided with oil passages 451 and 452 which communicate with an oil chamber between the end plate 450 and piston 446 and an oil chamber between the piston 446 and bottom wall of the cylinder tube 444. Accordingly, if oil pressure is supplied to either one of these oil chambers, the cylinder tube 444 is moved forward or backward relative to the block member 441.

Provided on the outer end face of the cylinder tube 444 is a shaft portion 453 which is projected outward of the block member 441 and has its axis disposed in eccentric relation with the outer periphery of the cylinder tube 444. The aforementioned fitting member 438 is rotatably fitted on this eccentric shaft portion 453. More specifically, the fitting member 438 is fitted on the outer end of the shaft portion 453 and its axial movement is blocked by a stop ring 454.

Figure 19:
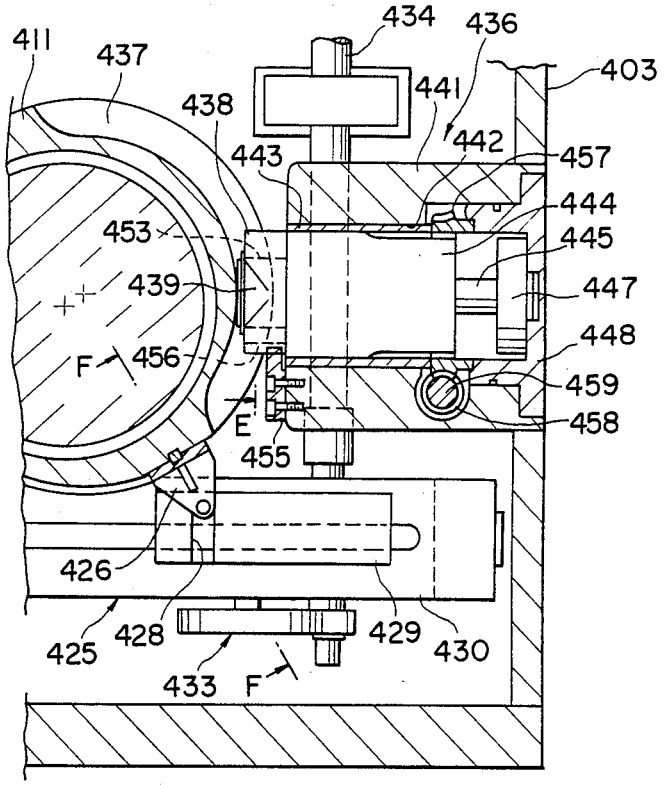
FIG. 19 is an enlarged fragmentary view showing major components of the caliber adjusting mechanism.

As illustrated in FIG. 19, the fitting member 438 is rotatable relative to the shaft portion 453 but its rotation relative to the block member 441 or the circumferential groove 437 is prohibited by a stopper 455. Namely, the fitting member 438 is provided with an axial stopper groove 456 on the lower side thereof to axially slidably receive stopper 455 which is fixedly mounted on the end face of the block member 441.

Figure 20:
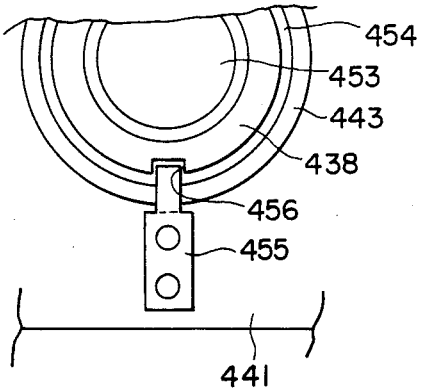
FIG. 20 is a view taken in the direction of arrow XX of FIG. 19.
Figure 21:
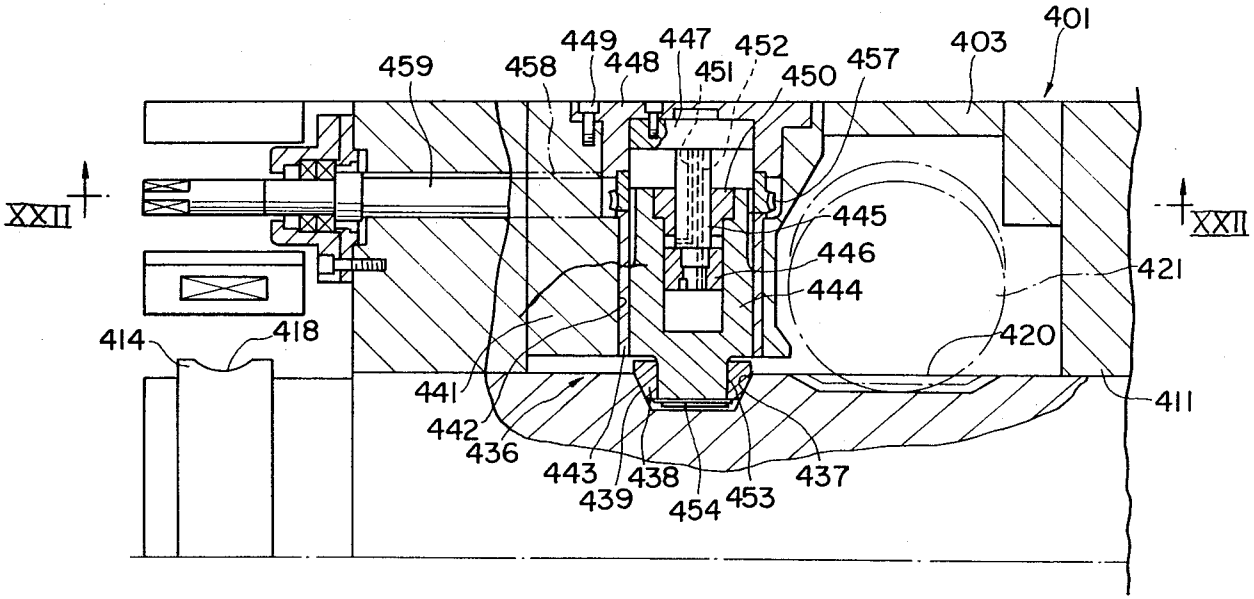
FIG. 21 is a sectional view taken through the longitudinal axis of the lower roll shaft.
Figure 22:
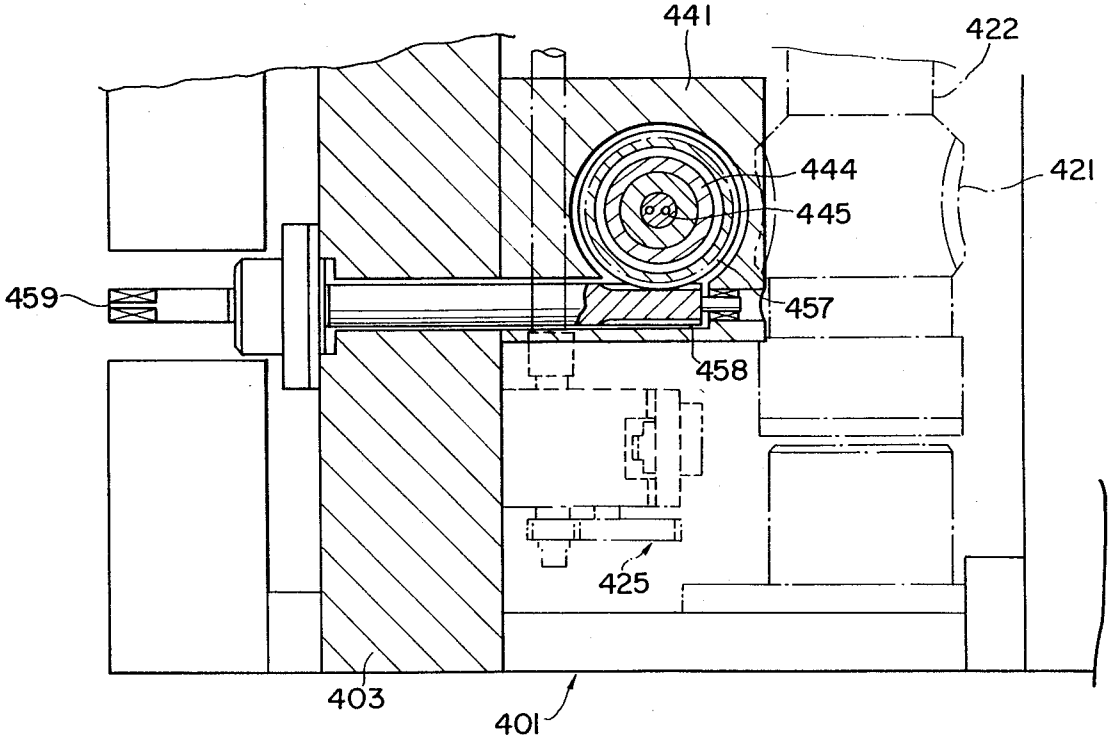
FIG. 22 is a sectional view taken on line XXII—XXII of FIG. 18.

As seen in FIGS. 20 and 21, the cylinder tube 444 is provided with a spline on the circumference of its inner end portion to permit relative axial movement of a worm wheel 457 which is fitted thereon. The worm wheel 457 is gripped between the worm presser 448 and bush 443 and restrained from axial movement relative to the bore 442 of the block member 441. The worm wheel 457 is meshed with a worm 458 which is rotatably supported on the block member 441 by a worm drive shaft 459 which has its axis disposed parallel with the axis of the eccentric cartridge 411. The outer end of the drive shaft 459 is projected on the outer side of the roll housing 403 and provided with a handle for manual operation or other suitable drive means.

In order to adjust the roll caliber by axially shifting the position of the eccentric cartridges 411, the fitting member 438 is brought into fitting engagement with the circumferential groove 437 of the eccentric cartridge 411 by protruding the cylinder tube 444 with hydraulic pressure, and then the cylinder tube 444 is turned by rotating the worm drive shaft 459 to move the fitting member 438 in the axial direction of the cartridge 411 through the eccentric shaft portion 453. Accordingly, the cartridge 411 which is in engagement with the fitting member 438 through it circumferential groove 437 is shifted in an axial direction.

Figure 18:
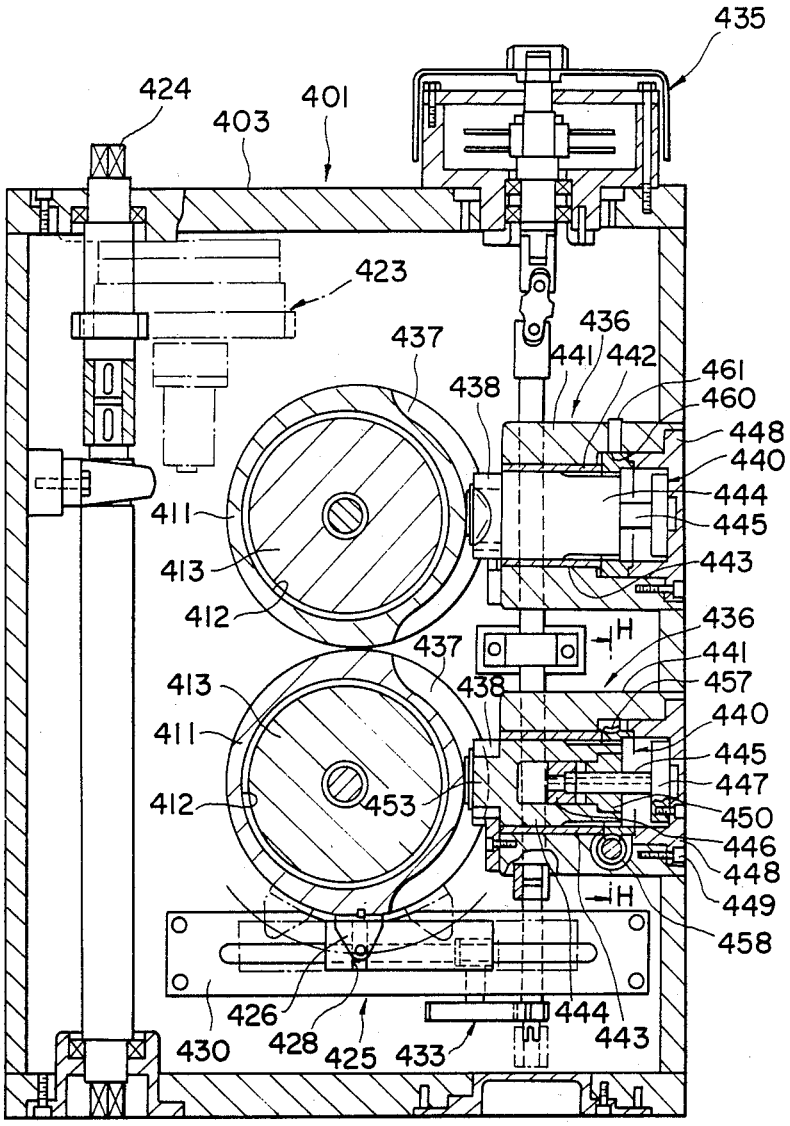
FIG. 18 is a diagrammatic sectional view of a cantilever type rolling mill incorporating a caliber adjusting mechanism according to the invention in addition to the pass clearance adjusting and indicating mechanisms.

In this embodiment of the invention, the cylinder tube 444 in the caliber adjusting mechanism for the other eccentric cartridge is not provided with a worm wheel and the shaft portion 453 which supports the fitting member 438 is formed in concentric relation with the cylinder tube, as shown in FIG. 18. This is because, for the caliber adjustment, it suffices to shift only one cartridge in an axial direction while holding the other cartridge against movements in an axial direction. Therefore, the cylinder tube 444 for the upper cartridge 411 has a ring 460 splined thereon instead of the worm wheel, fixing the ring 460 to the block member 441 by a knock pin 461 to prevent rotation of the cylinder tube 444.

However, in the case of a block mill which requires caliber adjustment at the center of a pass line, both of the upper and lower cylinder tubes have to be rotatable to permit adjustment of the two cartridges.

In order to adjust the caliber of the roll 413 in the particular embodiment shown, the oil pressure in the pressing means 440 is dropped to zero level, and the worm drive shaft 459 is manually rotated with the fitting member 438 engaged in the circumferential groove 437 of the cartridge 411 to rotated the worm wheel 457. Thereupon, the cylinder tube 444 is rotated through the spline, and the fitting member 438 is turned arcuately due to the eccentricity of the shaft portion 453, pushing the cartridge 411 to slide in the axial direction.

After the caliber adjustment, oil pressure is supplied again to the pressing means 440 to press the fitting member 438 against the circumferential groove 437, thereby securely clamping the cartridge 411 to the roll housing 403 to prevent fluttering of the cartridge 411 during rolling operation.

As clear from the foregoing description, the rolling mill according to the present invention basically employs a crack-free roll assembly which is adapted to transmit torque to a ring roll by application lateral compressive force, optionally incorporating in combination therewith a coupling head support mechanism, a pass clearance adjusting (screw down) mechanism, a pass clearance (screw down) indicator and/or a roll caliber adjusting mechanism which contribute considerably to facilitate the job of roll replacement, and adjustment of pass clearance or roll caliber on line.

What is claimed is:

1. A cantilever type rolling mill, including a pair of roll shafts rotatably supported in a roll housing through a coupled of eccentric cartridges and a pass clearance adjusting mechanism adapted to vary the pass clearance by rotation of said eccentric cartridges, said pass clearance adjusting mechanism comprising:

rotary drive means;

a plurality of worm wheels provided around a circumference of each of the respective eccentric cartidges;

a hollow worm shaft connected to said rotary drive means;

worm means disengageably meshed with said worm wheels on said eccentric cartridges and mounted on said hollow worm shaft;

an operating shaft fitted in said hollow worm shaft eccentrically relative to axes of said worms and which further comprises means for bringing said worms into or out of meshing engagement with said worm wheels; and a pass clearance indicator connected to one of said eccentric cartidges wherein said eccentric cartridges are movable in the axial direction and wherein said pass clearance indicator further comprises rotation pick-up means which includes a cam lever fixedly mounted on one of said eccentric cartridges, a cam roller rotatably supported at the fore end of said cam lever and a cam guide slidably mounted on a slide frame and movable in a direction parallel with a line tangential to said eccentric cartridge, a transmission mechanism connected to said rotation pick-up means and which further comprises rack and pinion means for converting linear sliding movement of said cam guide into rotating movement of said pinion and a gear train, an indicator including a rotary dial mounted on said roll housing and having a rotary input shaft thereof connected to the output end of said transmission mechanism, said rotary dial being rotated in proportion to the rotational angle of said eccentric cartridge to indicate an effective pass clearance.

2. A cantilever type rolling mill, including a pair of roll shafts rotatably supported in a roll housing through a couple of eccentric cartridges and a pass clearance adjusting medhanism adapted to vary the pass clearance by rotation of said eccentric cartridges, said pass clearance adjusting mechanism comprising:

rotary drive means;

a plurality of worm wheels provided around a circumference of each of the respective eccentric cartridges;

a hollow worm shaft connected to said rotary drive means;

worm means disengageably meshed with said worm wheels on said eccentric cartidges and mounted on said hollow worm shaft;

an operating shaft fitted on said hollow worm shaft eccentrically relative to axes of said worms and which further comprises means for bringing said worms into or out of meshing engagement with said worm wheels;

a pass clearance indicator connected to one of said eccentric cartridges wherein said eccentric cartridges are movable in the axial direction; and a caliber adjusting mechanism provided for each of said eccentric cartridges and permitting rotational movement of said eccentric cartridges at a time of adjustment of pass clearance as well as axial movement of at least one of said eccentric cartridges for the adjustment of a roll caliber in the axial direction.

3. The rolling mill as set forth in claim 2 wherein said caliber adjusting mechanism for at least one of said eccentric cartridges further comprise a fitting member mounted on an eccentric shaft portion of said cylinder tube and a manually operable drive shaft connected to said cylinder tube through said worm means to rotate said cylinder tube about the axis thereof, causing said fitting member in said circumferential groove to move arcuately thereby displacing said eccentric cartridge in the axial direction for axial adjustment of the roll caliber.

4. The rolling mill as set forth in claim 2, wherein said caliber adjusting means further comprises a cylinder tube protrudable toward the respective eccentric cartridge and a fitting member mounted on a shaft portion of said cylinder tube and engagable in a circumferential groove formed on said eccentric cartridge over a predetermined length on one side thereof, said cylinder tube pressing said eccentric cartridge against the roll stand during rolling operation of said mill.

* * * * *